United States Patent [19]

Keely et al.

[11] Patent Number: 4,970,494

[45] Date of Patent: Nov. 13, 1990

[54] RADIO CONTROLLED HOME SECURITY SYSTEM

[76] Inventors: William A. Keely, 1951 N. Baldwin Rd., Oxford, Mich. 48051; Ilona A. Ross, 2914 Eagle Dr., Rochester Hills, Mich. 48309; Frank J. Sabo, 1606 W. Ewing Ave., South Bend, Ind. 46613

[21] Appl. No.: 438,845

[22] Filed: Nov. 20, 1989

[51] Int. Cl.[5] ..... G08B 13/18; E05B 45/06

[52] U.S. Cl. ..... 340/567; 250/342; 340/539; 340/542

[58] Field of Search ..... 340/567, 545, 541, 539, 340/426, 542, 574; 250/342

[56] References Cited

U.S. PATENT DOCUMENTS

| | | | |
|---|---|---|---|
| 3,891,980 | 6/1975 | Lewis et al. | 340/572 |
| 3,936,673 | 2/1976 | Kelly et al. | 340/426 X |
| 4,196,422 | 4/1980 | Swigert et al. | 340/542 |
| 4,370,644 | 1/1983 | Droz | 340/542 X |
| 4,590,460 | 5/1986 | Abbott et al. | 340/567 X |
| 4,594,580 | 6/1986 | Nelson | 340/539 X |
| 4,794,368 | 12/1988 | Grossheim et al. | 340/539 X |
| 4,833,449 | 5/1989 | Gaffigan | 340/539 X |

*Primary Examiner*—Joseph A. Orsino
*Assistant Examiner*—Thomas J. Mullen, Jr.
*Attorney, Agent, or Firm*—Warren D. Hill

[57] ABSTRACT

A security system has a wall mounted assembly for installation adjacent an entry door and includes a motion detector for sensing intruders, an alarm for sounding a warning, an alarm circuit, a radio receiver responsive to two codes, and an electric door striker. A portable miniature transmitter has two transmission codes to activate the receiver, one for toggling the alarm circuit between armed and disarmed condition and for releasing the door upon disarming the alarm circuit. When the circuit is armed the motion detector is able to activate the alarm. The second transmission code activates the alarm if the circuit is armed. Remote self contained motion detector and transmitter units for use in other rooms use the second code to activate the alarm when motion is detected by those units.

7 Claims, 2 Drawing Sheets

RADIO CONTROLLED HOME SECURITY SYSTEM

FIELD OF THE INVENTION

This invention relates to security systems and particularly to such a system for intrusion detection and door entry control.

BACKGROUND OF THE INVENTION

A number of expensive and elaborate security systems are available to protect homes against unauthorized entry. A variety of sensors are used to detect the opening of a door or window or to detect motion within a dwelling and then activate an alarm, providing the alarm is activated. It is axiomatic that the system must accommodate the normal activities of the occupants of the home without sounding an alarm. This usually requires that the system be disarmed when entering the home and armed when leaving the home. It is also known to unlock or unlatch a door by remote control as by a radio link so that an authorized person having a properly coded radio transmitter can cause the door to unlatch by activating the transmitter when approaching the door. This avoids the inconvenience of finding the correct key and finding the keyhole which is difficult while carrying packages, for example, and also avoids a delay when a person might desire quick entry for security purposes. It is desirable to integrate a door opener and an intrusion detector into a single system since door entry and disarming the alarm are joint functions.

Generally, the available security systems are permanently installed in a home and cannot be readily removed. In many situations, particularly where the home is a rented apartment, the occupants desire to have a security system even though they may expect to live there for such a short time that the installation of a conventional security system is not economically justified. It is thus desirable to have a security system which can be readily installed and subsequently removed without permanent damage to the dwelling so that it may be reinstalled in another place.

SUMMARY OF THE INVENTION

It is therefore an object of the invention to provide an integrated door opening and intrusion alarm system.

It is another object of the invention to provide a security system including a door opening function which is easy to install and practical to remove for reuse in another location.

The invention is carried out by a security system for a home comprising: a radio system having a receiver means and a portable transmitter, the transmitter having means for emitting a coded signal and the receiver means being responsive to the coded signal for producing an output, a toggle circuit responsive to the receiver means output to change between a first and a second state, an alarm circuit, means coupled to the toggle circuit and the alarm circuit for arming the alarm circuit when the toggle circuit is in the first state and disarming the alarm circuit when the toggle circuit is in the second state, an electrically operated door striker, means coupled to the door striker and the toggle circuit for releasing the striker when the toggle circuit is in the second state, and a motion detector coupled to the alarm circuit and effective when the circuit is armed to activate the alarm upon detection of motion.

The invention further comprehends the use of two radio channels, the first being used to disarm the alarm and release the striker or alternately arm the alarm, and the second channel is used to just activate the alarm it is armed, and remote motion detector/transmitter units using the second channel to activate the alarm.

BRIEF DESCRIPTION OF THE DRAWINGS

The above and other advantages of the invention will become more apparent from the following description taken in conjunction with the accompanying drawings wherein like references refer to like parts and wherein.

DESCRIPTION OF THE INVENTION

Figure 1:
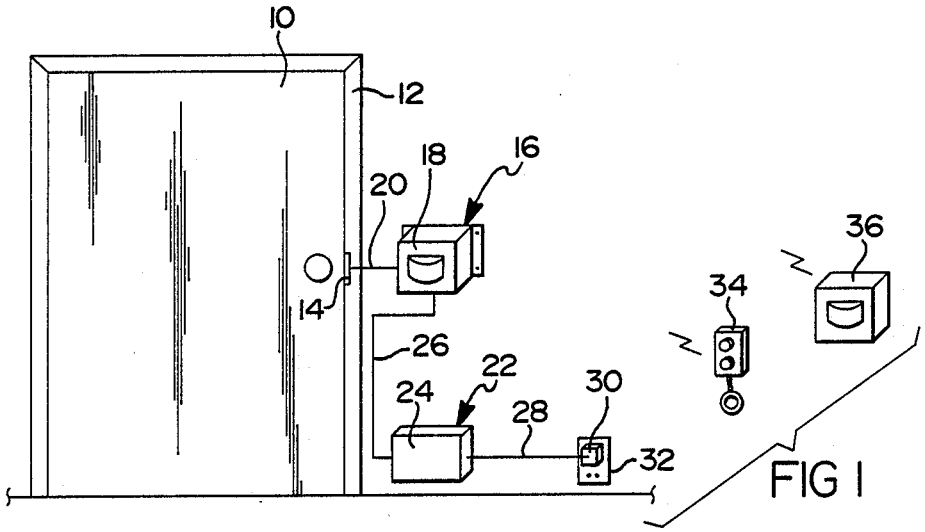
FIG. 1 is a view of a security system according to the invention as installed at an entry door.

The security system described herein was developed for easy installation and easy removal while causing no more damage to the dwelling than hanging pictures on the wall. The system is indeed hung on the wall like pictures and attached to the door jamb. As shown in FIG. 1, an entry door 10 of a dwelling is surrounded by a frame 12 concealing the door jamb. An electric striker 14 (or one striker for each lock) is mounted on the door jamb in place of the standard striker. To install the electric striker 14, the standard striker is removed and replaced by the electric striker. The procedure is reversed when it is necessary to remove the security system. The system has an upper base unit 16 contained in a housing 18 which is mounted on the wall adjacent the door 10. The unit 16 is connected to the electric striker 14 by a short, inconspicuous two wire conductor 20. The system further has a lower base unit 22 having a housing 24 mounted on the wall adjacent the door 10 and preferably near the floor to be inconspicuous. A three-wire conductor 26 connects the upper and lower base units 16, 22 and can be inconspicuously routed along the door frame 12. The lower base unit 22 is connected by a line 28 to a separate 12 volt transformer 30 which is plugged into a 110 volt wall receptacle 82. A portable radio transmitter 34 of the type which is carried on a key chain is linked by radio waves to the upper unit 16. The transmitter 34 has two push buttons for channels #1 and #2 respectively. An optional part of the system is a self contained battery powered remote motion detector and transmitter unit 36 also linked by radio waves on channel #2 to the upper unit 16. The motion detector is a passive infrared motion detector and the transmitter is coded to operate on channel #2. The remote unit 36 is wall mounted in another part of the dwelling or if desired, may sit on a table or the like.

Figure 2:
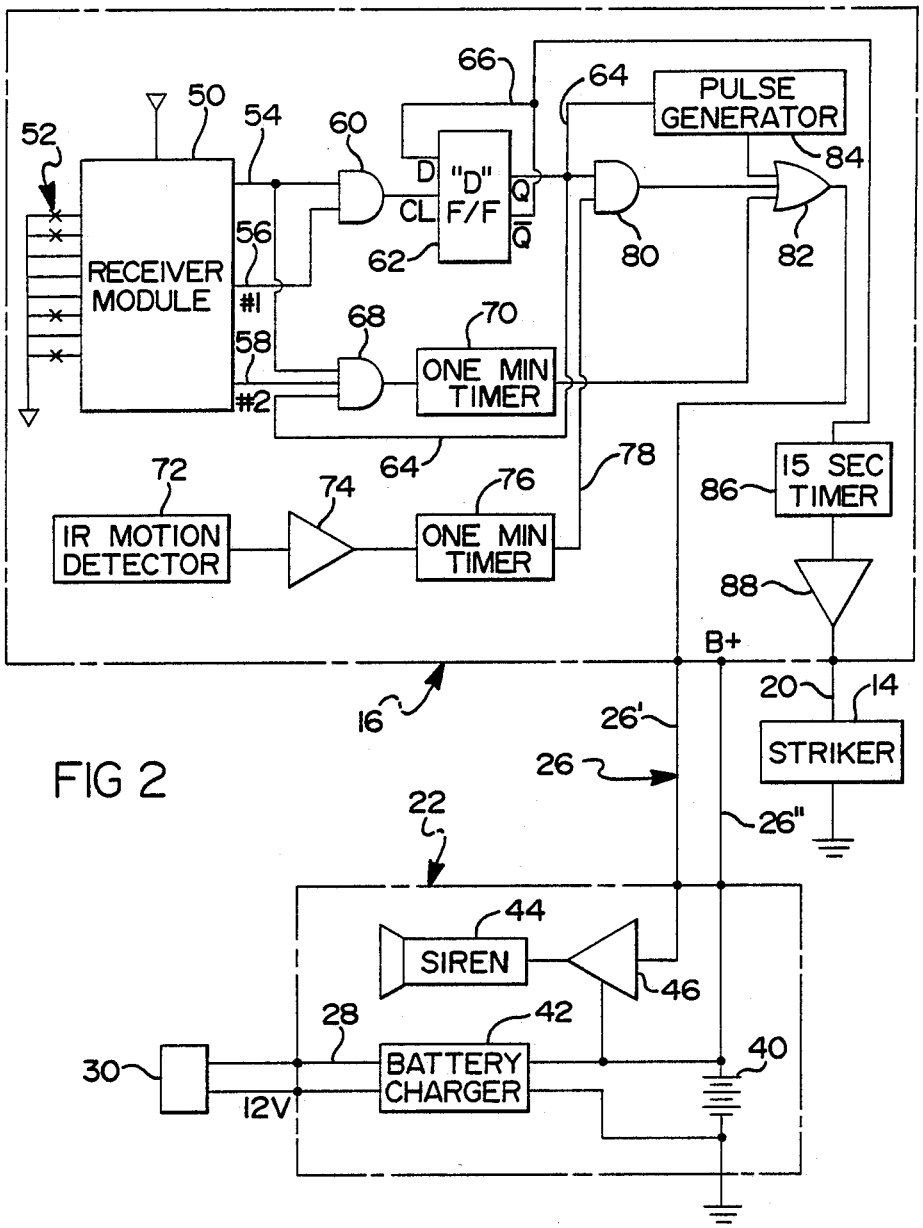
FIG. 2 is a schematic diagram of the security system according to the invention.

As shown in FIG. 2, the lower base unit 22 includes a battery 40, a battery charger 42 coupled to the battery and powered by the transformer 30, an alarm or siren 44, and an amplifier 46 for energizing the siren. The conductor 26 coupling the upper and lower base units includes an alarm activation line 26', a power (B+) line 26'' and a ground line. The amplifier 46 is always coupled to the battery and energizes the siren whenever a low voltage is not present on line 26'. Normally, the low voltage is impressed on line 26' by the upper unit to hold the alarm off. The low voltage is removed when the upper unit commands an alarm or when the line 26' is disconnected from either unit. Thus the alarm has a fail active feature to foil tampering by an intruder.

The upper base unit 16 includes a receiver module 50 which comprises an AM receiver and a decoder to activate either channel #1 or channel #2 upon receipt of a preset code. The receiver and transmitter comprise well known AM circuitry operating, for example, at 295 MHz operating in a pulse burst mode. Either binary or trinary codes are impressed on the signal by pulse width modulation so that the width of each pulse burst corresponds to the status of a bit in the code. The decoder includes a plurality of wires 52 initially connected to ground, each wire representing one bit of an 8-bit code. The wires 52 are selectively cut, as indicated by x's on the drawing, to establish the code for a receiver module. When the correct code is received a valid transmission signal is generated on output line 54. Additional data bits in the signal are used to activate either channel #1 or #2 on lines 56 and 58, respectively. Lines 54 and 56 are connected to the inputs of an AND gate 60 which has its output coupled to the clock input terminal of a D-type flip-flop 62. The Q output of the flip-flop 62 is connected to line 64 while the Q-inverted output is connected to line 66 which is connected to the data input of the flip-flop. Thus the flip-flop 62 acts as a toggle circuit, changing its state on lines 64 and 66 each time a rising pulse is received on its clock input. Lines 54 and 58 and 64 are connected to the three inputs of an AND gate 68 which has an output connected to a one minute timer 70. When the gate 68 output goes high the timer 70 goes high for one minute.

A passive infrared motion detector 72 such as Amperex Corp. detector model no. RPW100 is mounted in the upper unit 16 to monitor movement in the room where it is installed and has its output coupled through an amplifier 74 to another one minute timer 76 to energize its output on line 78 for one minute when the amplifier output goes high. Line 78 and line 64 from the flip-flop 62 are connected to the inputs of an AND gate 80. The output of gate 80 as well as the output of the timer 70 are connected to inputs of an OR gate 82. A pulse generator 84 is connected to line 64 and produces one or two pulses when activated which are coupled to an input of the OR gate B2. The OR gate output is on line 26' which goes high when energized to trigger operation of the siren 44. Otherwise the OR gate output is low to hold the alarm off. The line 66 from the flip-flop 62 is connected to the input of a 15 second timer 86 which has its output coupled through an amplifier 88 to the electric striker 14 so that the striker is released for 15 seconds when line 66 goes high.

In operation, when the channel #1 button on the transmitter 34 is pressed, the coded signal is sent to the receiver which verifies the correct code and the channel #1 data bits to energize lines 54 and 56. The AND gate 60 generates a rising pulse to the flip-flop 62 which changes state on both of its outputs. Each time the channel #1 is energized the flip-flop changes state or toggles. When the line 64 goes positive the pulse generator issues one pulse causing the siren to chirp once. At the same time the line 64 input of AND gate 80 goes high to arm the alarm circuit; that is, if the IR motion detector 72 detects motion, it will energize the siren via the AND gate 80. When the signal on line 64 goes low the AND gate 80 is disabled and the IR motion detector is unable to energize the alarm; thus the circuit is disarmed. At the same time, the line 66 goes high and the striker is released for 15 seconds. Hence each time the channel #1 is energized the alarm circuit is armed or, alternately, the circuit is disarmed and the striker is released to unlatch the door.

The signal on line 64 arms the AND gate 68 at the same time the gate 80 is armed. When the channel #2 button on the transmitter 34 is pressed or the remote IR detector/transmitter unit 86 is actuated, the coded signal is sent to the receiver which verifies the correct code and the channel #2 data bits to energize lines 54 and 58. Then if the AND gate 68 is armed, it conducts to immediately activate the siren for one minute under control of the timer 76. The channel #2 button on the transmitter is used to issue a warning when a person carrying the transmitter 34 senses danger, whether inside or outside the dwelling.

Figure 3:
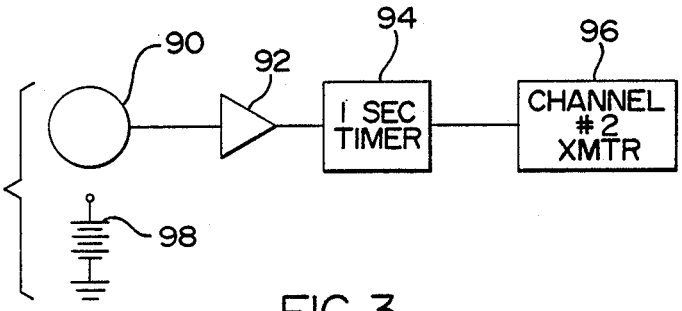
FIG. 3 is a schematic diagram of a remote motion detection unit of FIG. 1.

FIG. 3 shows the remote IR detector/transmitter unit 36. A passive IR motion detector 90 like that used in the base unit is coupled through an amplifier 92 to a one second timer 94 which energizes the transmitter 96 which sends the code for channel #2 to the receiver module 50. The remote unit also contains its oWn battery 98 for supplying power to the components 90–96.

It will thus be seen that the system according to the invention has minimal installation requirements and can be easily removed and relocated with little residual damage to the dwelling. It will also be recognized that the system allows keyless entry to a dwelling by a key chain type transmitter. The alarm is automatically disarmed when the door striker is released and it is armed at any time by the transmitter. The transmitter is also used to activate the alarm any time the system is armed without operating the striker. Remote motion detector units in other rooms of the dwelling are radio linked to the receiver to activate the alarm when motion is detected in a room so equipped.

The embodiments of the invention in which an exclusive property or privilege is claimed are defined as follows:

1. A security system for a home comprising: a radio system having a receiver means and a portable transmitter, the transmitter having means for emitting a coded signal and the receiver means being responsive to the coded signal for producing an output, a toggle circuit responsive to the receiver means output to change between a first and a second state, an alarm circuit, means coupled to the toggle circuit and the alarm circuit for arming the alarm circuit when the toggle circuit is in the first state and disarming the alarm circuit when the toggle circuit is in the second state, an electrically operated door striker, means coupled to the door striker and the toggle circuit for releasing the striker when the toggle circuit is in the second state, and a motion detector coupled to the alarm circuit and effective when the circuit is armed to activate the alarm upon detection of motion.

2. The invention as defined in claim 1 including a second transmitter having a second coded signal and the receiver means being responsive to the second coded signal to produce a second output, a second motion detector coupled to the second transmitter for activating the second transmitter upon detection of motion, and means connecting the second output to the alarm circuit and effective when the circuit is armed to activate the alarm upon detection of motion by the second motion detector.

3. The invention as defined in claim 1 wherein the portable transmitter has means for emitting a second coded signal and means for selectively actuating either signal, and the receiver means being responsive to the second coded signal for producing a second output, and a circuit responsive to the second output and effective when the alarm circuit is armed to activate the alarm.

4. The invention as defined in claim 2 wherein the portable transmitter has means for emitting the said second coded signal and means for selectively actuating either signal, whereby the receiver means produces the said second output effective when the circuit is armed to activate the alarm when the second coded signal is emitted by the portable transmitter.

5. A home security system for controlling an entry door and for monitoring an area adjacent the door against intrusion comprising:

an electric door striker for mounting on a door frame to release an entry door when activated, a portable transmitter for emitting a coded signal when activated, a first base unit having a power supply and an alarm, a second base unit electrically connected to the first base unit and mounted adjacent to and connected to the striker, the second base unit having an infrared motion detector, an alarm actuation circuit coupled to the alarm, a radio receiver responsive to the coded signal and means responsive to the coded signal for alternately arming and disarming the alarm circuit when the transmitter is activated and for releasing the striker when the alarm circuit is disarmed, the alarm circuit including the said infrared motion detector effective when the circuit is armed to activate the alarm upon detection of motion.

6. The invention as defined in claim 5 including a remote transmitter for emitting a second coded signal when activated and a second motion detector connected to the remote transmitter for activating the transmitter upon motion detection, the receiver being responsive to the second coded signal to activate the alarm circuit when armed.

7. A home security system for controlling an entry door and for monitoring an area adjacent the door against intrusion comprising;

an electric door striker for mounting on a door frame to release an entry door when activated, a portable transmitter for emitting a coded signal when activated, a first base unit having a power supply and an alarm an having a first housing for wall mounting adjacent an entry door, a second base unit electrically connected to the first base unit and having a second housing for wall mounting adjacent to the striker, the second base unit having an infrared motion detector, an alarm actuation circuit coupled to the alarm, a radio receiver responsive to the coded signal and means responsive to the coded signal for alternately arming and disarming the alarm circuit when the transmitter is activated and connected to the striker for releasing the striker when the alarm circuit is disarmed, the alarm circuit including the said infrared motion detector effective when the circuit is armed to activate the alarm upon detection of motion.

* * * * *